US010018436B1

(12) United States Patent
Cross

(10) Patent No.: US 10,018,436 B1
(45) Date of Patent: Jul. 10, 2018

(54) CAPTIVE BEARING PIN SYSTEM

(71) Applicant: Wes Cross, San Diego, CA (US)

(72) Inventor: Wes Cross, San Diego, CA (US)

( * ) Notice: Subject to any disclaimer, the term of this patent is extended or adjusted under 35 U.S.C. 154(b) by 0 days.

(21) Appl. No.: 15/475,635

(22) Filed: Mar. 31, 2017

(51) Int. Cl.
*F41C 27/00* (2006.01)
*F41A 11/00* (2006.01)
*F41A 3/66* (2006.01)

(52) U.S. Cl.
CPC ..... *F41A 11/00* (2013.01); *F41A 3/66* (2013.01)

(58) Field of Classification Search
CPC .. F41C 27/00; F41C 7/00; F41A 11/00; F41A 35/00
USPC ..... 42/106
See application file for complete search history.

(56) References Cited

U.S. PATENT DOCUMENTS

| | | | | |
|---|---|---|---|---|
| 8,756,845 | B2 * | 6/2014 | Harris | F41A 9/64 42/16 |
| 9,568,261 | B1 * | 2/2017 | Hall | F41A 3/66 |
| 9,797,666 | B2 * | 10/2017 | Schuetz | F41A 11/02 |
| 2017/0016690 | A1 * | 1/2017 | Timmons | F41A 11/00 |
| 2017/0227312 | A1 * | 8/2017 | Christensen | F41A 9/65 |

* cited by examiner

*Primary Examiner* — J. Woodrow Eldred
(74) *Attorney, Agent, or Firm* — Eric Hanscom

(57) ABSTRACT

In broad embodiment, the present embodiment is a front takedown pin mechanism that improves the longevity and motion of the upper and lower receivers of an AR-15 style firearm. The present embodiment also improves the removal of the front takedown pin.

While the foregoing written description of the embodiment enables one of ordinary skill to make and use what is considered presently to be the best mode thereof, those of ordinary skill will understand and appreciate the existence of variations, combinations, and equivalents of the specific embodiment, method, and examples herein. The embodiment should, therefore, not be limited by the above described embodiment, method, and examples, but by all embodiments and methods within the scope and spirit of the embodiment.

19 Claims, 3 Drawing Sheets

CAPTIVE BEARING PIN SYSTEM

CROSS-REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

The present invention is in the technical field of firearms. More particularly, the present invention is in the technical field of firearm pins. More particularly still, the present invention is in the field of firearm pins that can have pieces of a firearm or firearm accessories that pivot about the pin in a manner that increases efficiency and decreases the wear and tear on the pivot point.

Semi-automatic firearms have been known for a long time, the first semi-automatic rifle was introduced in 1885. The M-16 automatic rifle was designed in 1956 and has been used by the military from 1964. A civilian version of the M-16 is known as the AR-15 and is a semi-automatic rifle. The AR-15 has been manufactured and sold to civilians for many years.

The front takedown pin of an AR-15 style firearm is often difficult to remove, and in many cases requires the use of a pin or small tool or other pointed device. The present embodiment aids in the removal of the front takedown pin without the need for a tool. Additionally, the front takedown pin on an AR-15 style firearm can be accidentally moved from its intended place when bumped hard or mishandled. These issues are solved by the present embodiment's incorporation of a nut at the end of the present embodiments assembly, the front takedown pin is now mechanically locked in place and cannot be knocked or bumped out of place. Additionally, when one wants to remove the present embodiment's front takedown pin, the process is simplified by unscrewing the nut partially and pushing on the outside of the nut, thus easily releasing the present embodiments pin without a tool of any kind.

In recent years there have been many new laws that apply to the civilian owned AR-15 firearm. One such law has called for the separation of two halves of a firearm in order to reload a magazine, by means of disassembling the action on a two part receiver, like that on all AR-15 style firearms. The law requires the rear takedown pin to be removed, the upper receiver lifted upwards and away from the lower receiver using the front takedown pin as the fulcrum, before the magazine may be removed.

It is also a common practice by weapon enthusiasts who use firearms with two part receivers, like that on an AR-15, to remove the rear takedown pin and pivot the upper receiver about the front takedown pin in order to access the inside of the firearm. This causes wear and tear that will be reduced with the implementation of the present invention.

The inception of this and other laws has created an increased need for separation of the two halves of a firearm, by means of pivoting about the front takedown pin. This increased frequency of pivoting about the front takedown pin has increased the wear and tear on the upper and lower receivers, as well as the front takedown pin. As with many moving parts that are exposed to sometimes hot and dusty, or wet and rainy conditions, the front takedown pin will wear more quickly under the elements. The present invention is intended to increase the longevity of these components by means of creating a captive bearing system, reducing wear and tear that would have been caused by the frequent use of the front takedown pin as a pivot point. As gun-related laws continue to constrain gun use, it is expected that this invention will become more and more valuable as it becomes an even more important part of a gun enthusiast's approach to keeping his/her guns legal.

The present embodiment's function is to reduce the wear and tear that comes about from repeated motion in the area of the front takedown pin, as well as more securely house the front takedown pin in the front of the firearm and aid in the removal of the front takedown pin without the use of a tool. This reduced wear and tear is achieved by the use of the present embodiment's front takedown pin which incorporates a bearing. The bearing creates a bearing surface about which the upper and lower receivers pivot. The bearing allows for repeated motion in the area of the front takedown pin, using the pins center as the fulcrum of motion. The present embodiment being held in place with a nut on one side, and a front takedown pin head with a flat anti-rotational surface stopping the rotation of the pin. The present invention is designed to fit within the space of the front takedown pin holes of the two halves of a firearm. This is a marked and important improvement over the prior art, which provided a mere rod that connected the two halves of a firearm. Obviously a restrained and protected bearing will allow for pivotal movement with much reduced friction and opportunity for contamination.

While the aforementioned embodiment is considered a preferred embodiment, an alternate embodiment could consist of the use of a slot that is similar to the slot in a standard front takedown pin, for a detent pin to retain the head of the alternate embodiment, when pulled out and pressed in the front takedown pin would stay captive in the hole adjacent to the detent pin. An alternate embodiment could also have a rounded head on the pin. An alternate embodiment could have a nut with a hex shaped head. One could also make an alternate embodiment comprised of a screw in place of the nut and put a threaded hole in the pin, swapping the positions of the tapped hole and threaded screw. One could also easily adapt this in to alternate embodiments in order to fit on to other weapon systems such as AR-10, Bull Pup and other variants which pivot about the pin. These alternate embodiments are incorporated into this application and are considered part thereof.

SUMMARY OF ONE EMBODIMENT

The present embodiment is a front takedown pin assembly, comprising of a front takedown pin, a nut and a bearing. The present embodiment's assembly replaces a standard front takedown pin on a firearm similar to an AR-15 style firearm. The present embodiment allows for the upper and lower receivers to pivot about the present embodiment's assembly without causing the wear and tear typically attributed to pivoting around a standard front takedown pin.

The present embodiment is intended to be placed in the same holes of the upper and lower receivers that a standard front takedown pin for an AR-15 style firearm would occupy. The present embodiment has a nut that threads on to the tip of the present embodiment's front takedown pin, which locks the present embodiment's assembly in place more securely than the typical front takedown pin. The nut on the present embodiment also aids in removal of the present embodiments front takedown pin; by partially unscrewing the nut and pressing on the nut to allow for grasping of the front takedown pins head, one can now completely unscrew the nut and pull away the present embodiments front takedown pin.

The present embodiment calls for a press fit bearing to be installed in the upper receiver's front takedown pin hole. The present embodiment is then assembled by passing the pin through the upper and lower receiver's front takedown pin holes, followed by attachment to the present embodiment's nut thereby, fixing the present embodiment in place securely. The present embodiment's front takedown pin can be installed and uninstalled by hand without the use of any tools, by means of unscrewing the nut partially and pressing on its face, thus moving the present embodiment's assembly, less the press fit bearing, away from the AR-15 style rifle.

There has thus been outlined, rather broadly, the more important features of the invention in order that the detailed description thereof may be better understood, and in order that the present contribution to the art may be better appreciated. There are additional features of the invention that will be described hereinafter and which will form the subject matter of the claims appended hereto. The features listed herein and other features, aspects and advantages of the present invention will become better understood with reference to the following description and appended claims. The accompanying drawings, which are incorporated in and constitute part of this specification, illustrate embodiments of the invention and, together with the description, serve to explain the principles of the invention.

It should be understood the while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

DRAWINGS—REFERENCE NUMERALS

Figure 1:
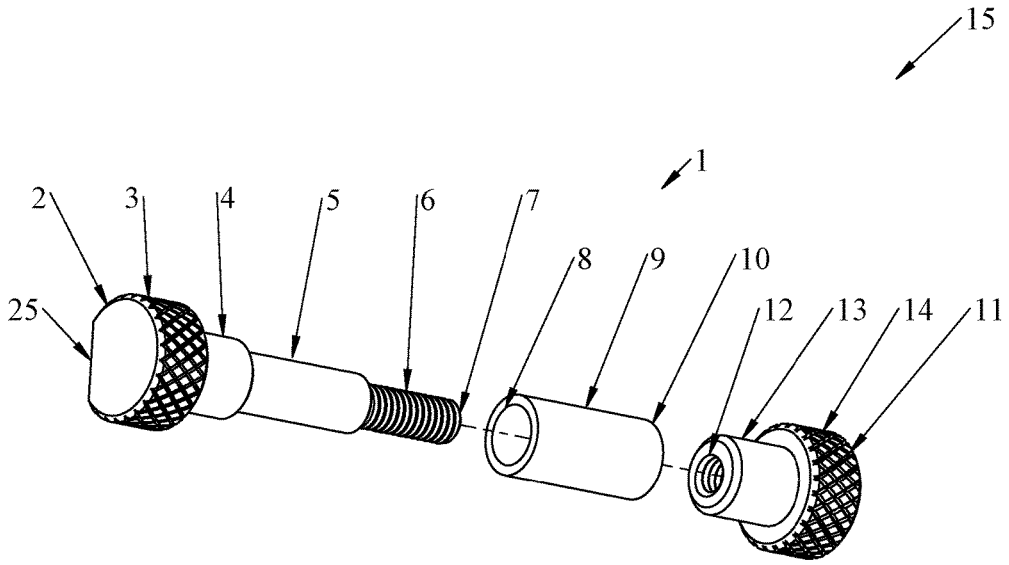
FIG. 1 is an isometric exploded view of present embodiment.

1. Present embodiment
2. Front takedown pin
3. Pin head
4. Pin load bearing surface
5. Pin bearing mount surface
6. Pin threaded end
7. Pin tip threaded end
8. Bearing inside surface
9. Bearing outside surface
10. Bearing
11. Nut
12. Nut threaded hole
13. Nut load bearing surface
14. Nut head
15. Isometric exploded view of present embodiment
16. Isometric assembled view of present embodiment
17. Isometric exploded view of present embodiment with AR-15 style parts
18. Side view of present embodiment installed on a AR-15 style parts
19. Section view A
20. AR-15 style upper receiver
21. AR-15 style lower receiver
22. AR-15 style upper receiver front pin hole
23. AR-15 style lower receiver front pin hole, right side
24. AR-15 style lower receiver front pin hole, left side
25. Pin anti-rotation surface
26. AR-15 style lower receiver anti-rotation surface
27. Direction of rotation
28. Upper receiver direction of motion

DETAILED DESCRIPTION OF THE EMBODIMENT

The present embodiment, which is a preferred embodiment, will now be described in detail with reference to the accompanying drawings. In the following description, numerous specific details are set forth in order to provide a thorough understanding of embodiments of the present embodiment. It will be apparent, however, to one skilled in the art, that embodiments may be practiced without some or all of these specific details. In other instances, well known process steps and/or structures have not been described in detail in order to not unnecessarily obscure the present embodiment. The features and advantages of embodiments may be better understood with reference to the drawings and discussions that follow.

Many aspects of the invention can be better understood with references made to the drawings below. The components in the drawings are not necessarily drawn to scale. Instead, emphasis is placed upon clearly illustrating the components of the present invention. Moreover, like reference numerals designate corresponding parts through the several views in the drawings. Before explaining at least one embodiment of the invention, it is to be understood that the embodiments of the invention are not limited in their application to the details of construction and to the arrangement of the components set forth in the following description or illustrated in the drawings. The embodiments of the invention are capable of being practiced and carried out in various ways. In addition, the phraseology and terminology employed herein are for the purpose of description and should not be regarded as limiting.

Since the basic firearm is of a well-known type, only those parts of the firearm essential to an understanding of the present embodiment will be described in detail. Although the present embodiment will be described with reference to the exemplary embodiments shown in the drawings, it should be understood that the present embodiment can be embodied in many alternate forms or embodiments. In addition, any suitable size, shape or type of elements or materials could be used. Indeed, any device which pivots about a rod could benefit from this technology.

The present embodiment is a front takedown pin assembly, comprising of a front takedown pin, a nut and a bearing. The present embodiment's assembly replaces a standard front takedown pin on a firearm similar to a AR-15 style firearm. The present embodiment allows for the upper and lower receivers to pivot about the present embodiment's assembly without causing the wear and tear typically attributed to pivoting around the front takedown pin. The present embodiment is intended to be placed in the same holes of the upper and lower receivers that a standard front takedown pin for an AR-15 style firearm would occupy.

The present embodiment has a nut that threads on to the tip of the present embodiment's front takedown pin, which locks the present embodiment's assembly in place more securely than the typical front takedown pin. The nut on the present embodiment also aids in removal of the present embodiments front takedown pin by partially unscrewing the nut and pressing on nut to allow for grasping of the opposite end of the present embodiment's front takedown pin head, one can now completely remove the nut and pull away the present embodiment's front takedown pin.

The present embodiment calls for a press fit bearing to be installed in the upper receiver's front takedown pin hole. The present embodiment is then assembled by passing the pin through the upper and lower receiver's front takedown pin holes. Then the present embodiment's nut is attached, fixing the present embodiment securely in place. The present embodiment's front takedown pin can be installed and uninstalled by hand without the use of any tools, by means of unscrewing the nut partially and pressing on it, thus moving the present embodiment's assembly, less the bearing, away from the AR-15 style rifle.

FIG. 1. Referring now to the present embodiment 1 in more detail. In FIG. 1 there is shown an isometric exploded view of present embodiment 15, 1. The present embodiment 1 consists of a front takedown pin 2 having a pin head 3, a pin anti-rotation surface 25, a pin load bearing surface 4, a pin bearing mount surface 5, a pin threaded end 6 and a pin tip threaded end 7. The present embodiment also consists of a bearing 10 having a bearing inside surface 8 and a bearing outside surface 9. The present embodiment also consists of a nut 11 having a nut head 14, a nut load bearing surface 13 and a nut threaded hole 12.

Figure 2:
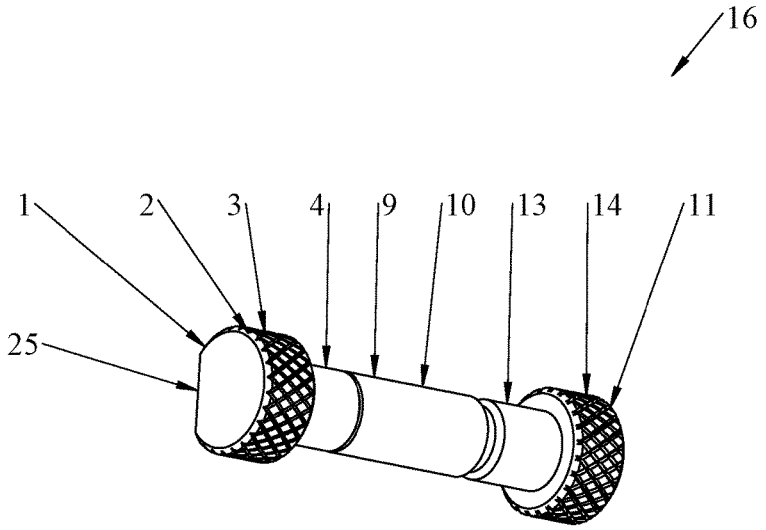
FIG. 2 is an isometric assembled view of present embodiment.

FIG. 2. Referring now to the present embodiment 1 in more detail. In FIG. 2 there is shown an isometric assembled view of present embodiment 16, 1. There is shown a front takedown pin 2 screwed in to a nut 11, that captures a bearing 10. The isometric assembled view of the present embodiment 16 shows the front takedown pin 2 having a pin head 3, a pin anti-rotation surface 25 and a pin load bearing surface 4. There is also shown a bearing 10 and the bearing outside surface 9. There is also shown a nut 11, which consists of a nut head 14 and a nut load bearing surface 13.

Figure 3:
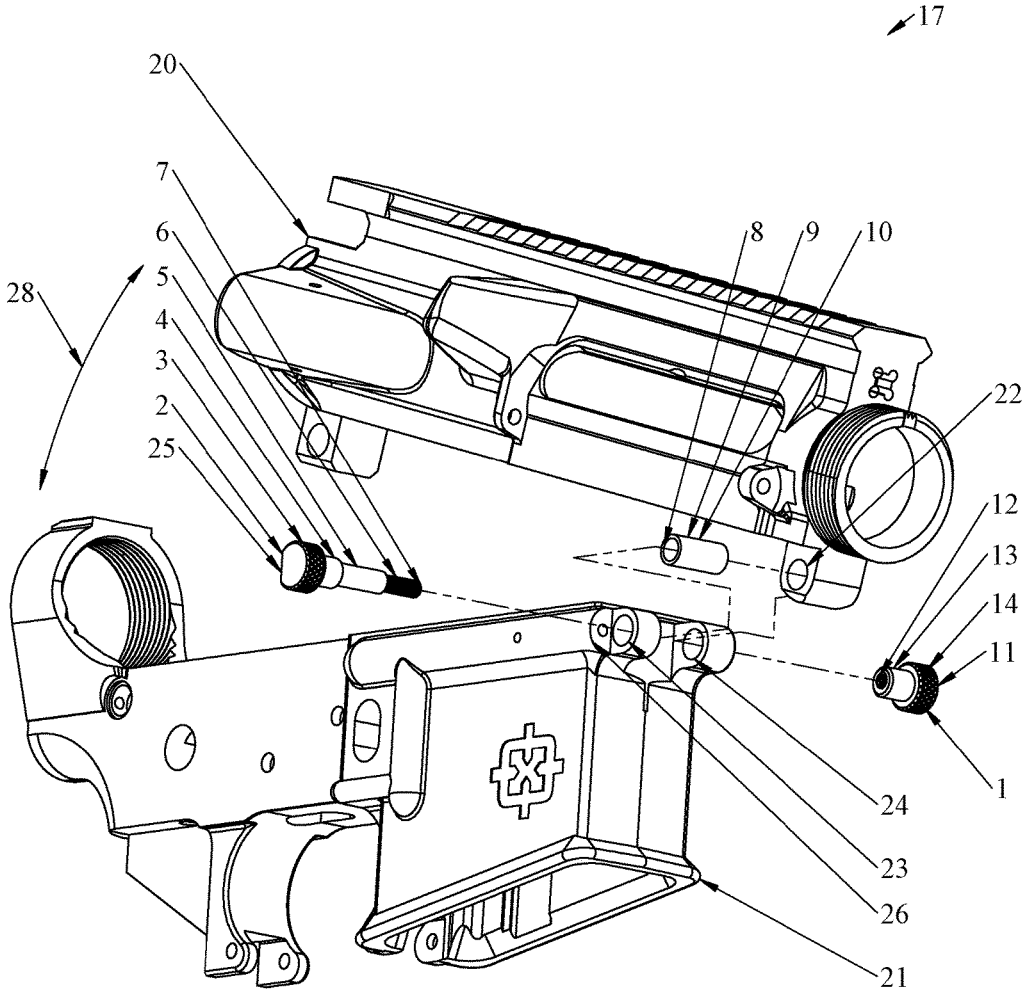
FIG. 3 is an isometric exploded view of present embodiment with AR-15 style parts.

FIG. 3. Referring now to the present embodiment 1 in more detail. In FIG. 3, there is shown an isometric, exploded view of present embodiment with AR-15 style parts 17, 1. The present embodiment 1 is installed onto an AR-15 style upper and lower receiver 20, 21, by first pressing the bearing 10 in to the AR-15 style upper receiver front pin hole 22, the bearing outside surface 9 is toleranced to press fit in to the AR-15 style upper receiver front pin hole 22. To complete the fitment of the present embodiment 1 on to the AR-15 style receivers 20, 21, one would concentrically align the AR-15 style upper receiver front pin hole 22 between the AR-15 style lower receiver front pin hole, left and right side 23, 24, and then slide the front takedown pin 2 through the concentrically aligned holes 22, 23, 24. When the front takedown pin 2 is stopped by the pin head 3 from moving farther through the receiver holes 22, 23, 24, one attaches the nut 11 by threading it onto the pin tip threaded end 7. When the nut 11 is fully tightened on the pin threaded end 6 the nut load bearing surface 13 will be resting within the AR-15 style lower receiver front pin hole, left side 24. The front takedown pin 2 will have its pin load bearing surface 4 resting within the AR-15 style lower receiver front pin hole, right side 23. The front takedown pin bearing mount surface 5 rests within the bearing inside surface 8, which is a tight tolerance fit. The pin head 3 has a flat anti-rotation surface 25 that is parallel with the AR-15 style lower receiver anti-rotation surface 26.

Figure 4:
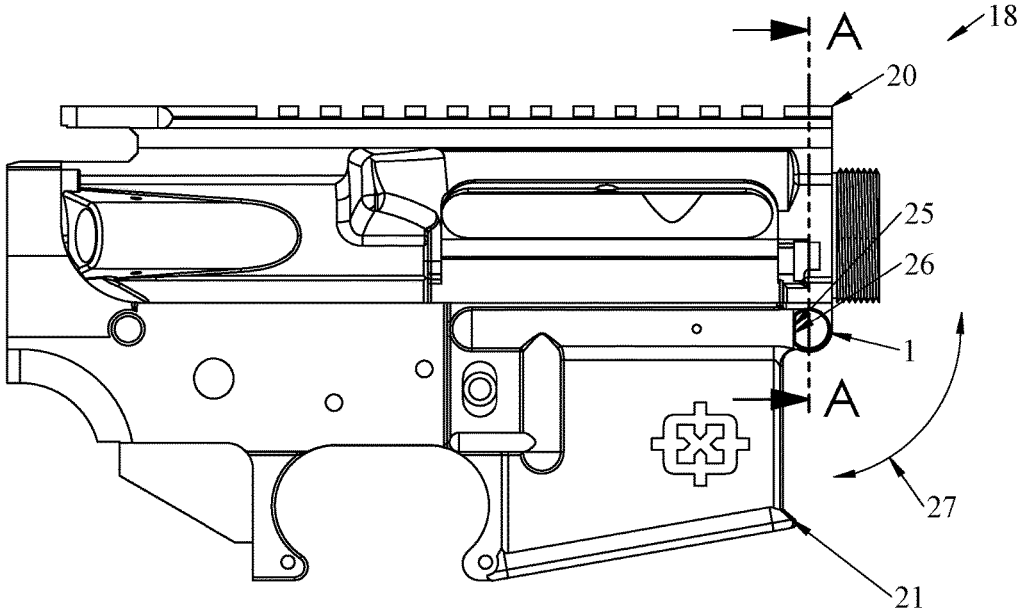
FIG. 4 is a side view of the present embodiment installed on a AR-15 style parts.

FIG. 4. Referring now to the present embodiment 1 in more detail. In FIG. 4, there is shown a side view of present embodiment installed on an AR-15 style parts 18, 1. The present embodiment 1 is installed on an AR-15 style upper and lower receivers 20, 21. The present embodiment 1 is arrested form rotation because of the pin anti-rotation surface 25, which is parallel with the AR-15 style lower receiver anti-rotation surface 26. The anti-rotational surfaces 25, 26, prevent the front takedown pin 2 from rotating in the direction of rotation 27 shown.

Figure 5:
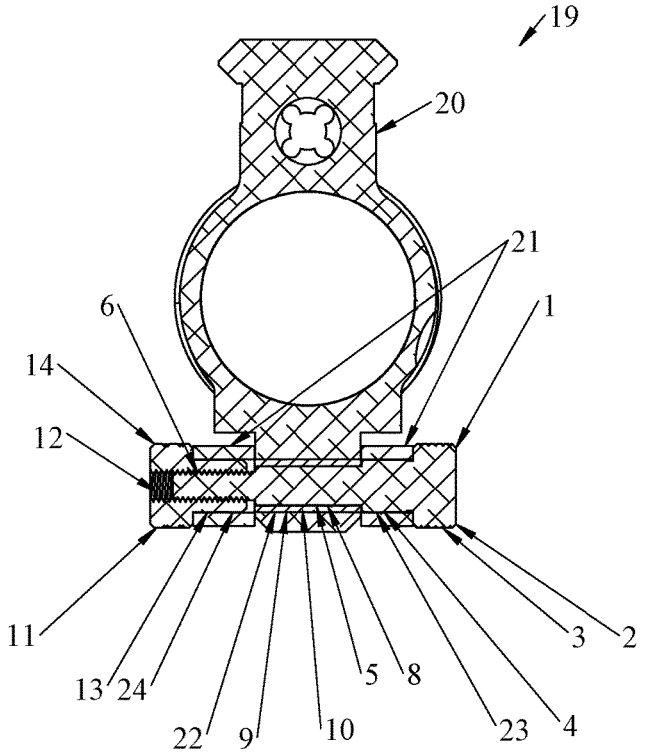
FIG. 5 is section view A of the present embodiment.

FIG. 5. Referring now to the present embodiment 1 in more detail. In FIG. 5, there is shown section view A of the present embodiment, 19, 1. The present embodiment 1 is shown passing through an AR-15 style upper receiver front pin hole 22, an AR-15 style lower receiver front pin hole, right and left side 23, 24. The present embodiment is secured to the AR-15 style upper and lower receivers 20, 21, by means of a nut 11 that has a nut threaded hole 12 that tightens on to the front takedown pins threaded end 6. The nut 11 has its nut load bearing surface 13 tolerance to fit tightly and concentrically with the AR-15 style lower receiver front pin hole, left side 24. The front takedown pin 2 has a pin load bearing surface 4 that is tightly toleranced to fit concentrically within the AR-15 style lower receiver front pin hole, right side 23. The front takedown pin 2 has a bearing mount surface 5 that is tightly tolerance to the bearing inside surface 8.

Operation of the Embodiment

Referring now to FIG. 3, the present embodiment 1, the present embodiments function is to reduce the wear and tear that comes about from repeated motion of the upper receiver's direction of motion 28, which pivots about the front takedown pin 2. The present embodiment 1 also more securely houses the front takedown pin 2 with a nut 11, the nut 11 additionally aids in the removal of the front takedown pin 2 without the use of a tool.

The present embodiment 1 is a front takedown pin assembly, comprising of a front takedown pin 2, a nut 11 and a bearing 10. The present embodiment 1 assembly replaces a standard front takedown pin on a firearm similar to an AR-15 style firearm. The present embodiment 1 allows for the AR-15 style upper and lower receivers 20, 21, to pivot about the present embodiment assembly 1 without causing the wear and tear typically attributed to pivoting around the front takedown pin. The present embodiment 1 is intended to be placed in the same holes of the upper and lower receivers in which a standard front takedown pin for an AR-15 style firearm would be located 22, 23, 24. The present embodiment has a nut 11 that threads onto the pins tip threaded end 7 of the present embodiment's front takedown pin 2, which locks the present embodiment assembly 1 in place more securely than the typical front takedown pin.

The present embodiment calls for a press fit bearing 10 to be installed in the AR-15 style upper receiver's front pin hole 22.

The present embodiment 1 is then assembled by first installing the press fit bearing 10 into an AR-15 style upper receiver front pin hole 22, then passing the front takedown pin 2 through the AR-15 style upper and lower receiver's front takedown pin holes 22, 23, 24, and then the present embodiment's nut 11 is attached, fixing the present embodiment 1 in place securely. After the present embodiment 1 is installed, the present embodiments front takedown pin 2 can be uninstalled and re-installed by hand without the use of any tools, by means of unscrewing the nut 11 and pressing on the nut 11 to allow for grasping of the opposite end of the present embodiments assembly's 1 front takedown pin head 3, one can now completely remove the nut 11 and pull away the present embodiments front takedown pin 2.

The bearing 10 creates a bearing surface for the AR-15 style upper and lower receivers 20, 21, to pivot about. The bearing 10 allows for repeated use of the upper receiver direction of motion 28, which pivots the AR-15 style upper receiver 20 about the front takedown pin 2, using the front takedown pin 2 as the fulcrum of the upper receiver direction of motion 28. The present embodiment 1 being held in place with a nut 11 on the left side and the front takedown pin 2 is held in place and arrested from motion by the pin anti-rotation surface 25 that is parallel with the AR-15 style lower receiver anti-rotation surface 26.

It should be understood that while the preferred embodiments of the invention are described in some detail herein, the present disclosure is made by way of example only and that variations and changes thereto are possible without departing from the subject matter coming within the scope of the following claims, and a reasonable equivalency thereof, which claims I regard as my invention.

All of the material in this patent document is subject to copyright protection under the copyright laws of the United States and other countries. The copyright owner has no objection to the facsimile reproduction by anyone of the patent document or the patent disclosure, as it appears in official governmental records but, otherwise, all other copyright rights whatsoever are reserved.

ADVANTAGES

The advantages of the present embodiment include, without limitation, the easy installation of a front takedown pin that securely locks in place with a nut. The present embodiment is also advantageous because of the incorporation of a bearing, which reduces wear and tear of the upper receiver which pivots about the front takedown pin. Compared to the current method which is a simple solid front takedown pin, one can now more permanently secure the front takedown pin with a nut. The current embodiment also makes the motion of pivoting the two halves of a weapon about the front takedown pin smoother, with less wear on the two halves and front takedown pin.

The present embodiment is also advantageous to those individuals who wish to remove the front takedown pin. The current method of removal of the front takedown pin often requires a pin or tool or pointed device of some sort to push the pin out. The present embodiment does not require a tool of any kind in order to remove the front takedown pin. One can simply unscrew the nut partially and press firmly on the nut and the front takedown pin will become free and can be easily removed.

What is claimed is:

1. A front takedown pin assembly for engaging an upper receiver to a lower receiver of a firearm, comprising:

a front takedown pin having an elongated cylindrical main body with a threaded section defined on a distal end and a pin head on a proximal end;

a bearing disposed between the threaded section and the pin head; and a nut;

wherein a substantially flat surface defined between the threaded section and the pin head, the bearing is disposed on the flat surface, wherein the front takedown pin is positioned through one or more concentrically aligned holes on the upper receiver to the lower receiver, wherein the threaded section extends outwardly from one side of the hole engaging the upper receiver to the lower receiver of the firearm and received into the nut, and wherein the nut facilitates engaging and disengaging of the assembly in the firearm by hand without the need for any tools.

2. The front takedown pin assembly of claim 1, wherein the elongated cylindrical main body include two flat surfaces, the threaded section defined on a distal end and the pin head on a proximal end.

3. The front takedown pin assembly of claim 1, wherein a first flat surface is pin load bearing surface and a second flat surface is pin bearing mount surface.

4. The front takedown pin assembly of claim 3, wherein a diameter of the first flat surface is greater than a diameter of the second flat surface.

5. The front takedown pin assembly of claim 1, wherein the threaded section is pin threaded end having male threads.

6. The front takedown pin assembly of claim 1, wherein the nut includes a nut head in one end and a nut load bearing extending from the nut head; the nut load bearing is hollow cylindrical bearing having internal female threads and the outer surface is flat surface.

7. The front takedown pin assembly of claim 1, wherein the nut having the internal female threads is engaged on the threaded section of the elongated cylindrical main body.

8. A takedown pin assembly for a firearm, comprising:

a pin having elongated cylindrical main body with a threaded section defined on a distal end and a pin head on a proximal end;

a bearing disposed between the threaded section and the pin head; and a nut;

wherein a substantially flat surface defined between the threaded section and the pin head, the bearing is disposed on the flat surface, wherein the assembly is configured for engaging an upper receiver to a lower receiver of the firearm, when the pin is positioned through the concentrically aligned holes on the upper receiver to the lower receiver, wherein the threaded section extends outwardly from one side of the hole engaging the upper receiver to the lower receiver of the firearm and received into the nut, and wherein the nut facilitates engaging and disengaging of the pin in the firearm by hand without the need for any tools.

9. The takedown pin assembly of claim 8, wherein the elongated cylindrical main body comprises two flat surfaces, a first flat surface is pin load bearing surface and a second flat surface is pin bearing mount surface.

10. The takedown pin assembly of claim 9, wherein a diameter of the first flat surface is greater than a diameter of the second flat surface.

11. The takedown pin assembly of claim 8, wherein the threaded section is pin threaded end having male threads.

12. The takedown pin assembly of claim 8, wherein the nut includes a nut head in one end and a nut load bearing extending from the nut head; the nut load bearing is hollow cylindrical bearing having internal female threads and the outer surface is flat surface.

13. The takedown pin assembly of claim 8, wherein the pin having the threaded section is screwed in the nut having the female threads in engaging the upper receiver to the lower receiver of the firearm.

14. The takedown pin assembly of claim 8, wherein the threaded section of the pin is unscrewed from the nut having the female threads in disengaging the upper receiver from the lower receiver of the firearm.

15. The takedown pin assembly of claim 8, wherein the nut is unscrewed from the pin to remove the pin for disengaging the upper receiver from the lower receiver of the firearm by hand without the use of any tools.

16. The takedown pin assembly of claim 8, wherein the bearing is a press fit bearing for engaging the upper receiver to the lower receiver of the firearm.

17. A front takedown pin assembly for engaging an upper receiver to a lower receiver of a firearm, consisting of:

a front takedown pin having an elongated cylindrical main body with a threaded section defined on a distal end and a pin head on a proximal end;

a bearing disposed between the threaded section and the pin head; and a nut;

wherein a substantially flat surface defined between the threaded section and the pin head, the bearing is disposed on the flat surface, wherein the front takedown pin is positioned through the one or more concentrically aligned holes on the upper receiver to the lower receiver, wherein the threaded section extends outwardly from one side of the hole engaging the upper receiver to the lower receiver of the firearm and received into the nut, and wherein the nut facilitates engaging and disengaging of the assembly in the firearm by hand without the need for any tools, wherein the elongated cylindrical main body include two flat surfaces, the threaded section defined on a distal end and the pin head on a proximal end, wherein a first flat surface is pin load bearing surface and a second flat surface is pin bearing mount surface.

18. The front takedown pin assembly of claim 17, wherein a diameter of the first flat surface is greater than a diameter of the second flat surface, wherein the threaded section is pin threaded end having male threads.

19. The front takedown pin assembly of claim 18, wherein the nut includes a nut head in one end and a nut load bearing extending from the nut head; the nut load bearing is hollow cylindrical bearing having internal female threads and the outer surface is flat surface, wherein the nut having the internal female threads is engaged on the threaded section of the elongated cylindrical main body.

* * * * *